US011839956B2

(12) United States Patent
Wu

(10) Patent No.: US 11,839,956 B2
(45) Date of Patent: Dec. 12, 2023

(54) BIT

(71) Applicant: CORE Tool Group, Inc., Corona, CA (US)

(72) Inventor: Zhong-Yue Wu, Tainan (TW)

(73) Assignee: CORE Tool Group, Inc., Corona, CA (US)

( * ) Notice: Subject to any disclaimer, the term of this patent is extended or adjusted under 35 U.S.C. 154(b) by 382 days.

(21) Appl. No.: 16/898,319

(22) Filed: Jun. 10, 2020

(65) Prior Publication Data

US 2020/0384617 A1 Dec. 10, 2020

Related U.S. Application Data

(60) Provisional application No. 62/859,615, filed on Jun. 10, 2019.

(51) Int. Cl.
*B25B 15/00* (2006.01)

(52) U.S. Cl.
CPC ..... *B25B 15/001* (2013.01)

(58) Field of Classification Search
CPC ..... B25B 15/00; B25B 15/001; B25B 15/004; B25B 15/005; B25B 15/008; B25B 23/00; B25B 23/142; B25B 23/0035
See application file for complete search history.

(56) References Cited

U.S. PATENT DOCUMENTS

| | | | | |
|---|---|---|---|---|
| 4,428,443 | A | 1/1984 | Oliphant | |
| 4,924,948 | A | 5/1990 | Chuang et al. | |
| 7,437,979 | B1 | 10/2008 | Wang | |
| D707,524 | S * | 6/2014 | Chen | D8/86 |
| D753,979 | S * | 4/2016 | Liu | D8/86 |
| D764,251 | S * | 8/2016 | Hsu | D8/86 |
| D766,691 | S * | 9/2016 | Liu | D8/86 |
| 9,938,774 | B2 | 4/2018 | Lyon | |
| 2015/0336246 | A1* | 11/2015 | Peters | H01F 7/02 81/439 |
| 2016/0325411 | A1* | 11/2016 | Wang | B25B 15/001 |
| 2017/0297183 | A1 | 10/2017 | Wang | |

FOREIGN PATENT DOCUMENTS

DE 2751818 A 6/1978

* cited by examiner

*Primary Examiner* — Robert J Scruggs
(74) *Attorney, Agent, or Firm* — Umberg Zipser LLP

(57) ABSTRACT

Various embodiments of bits are described having a drive portion, a shank and a head portion or tip. The shank can comprise a set of raised rings that extend from an outer surface of the shank. The rings are spaced apart along the shank starting from the head portion, and preferably have different distances between at least two adjacent pairs of rings.

16 Claims, 5 Drawing Sheets

BIT

This application claims priority to U.S. provisional patent application having Ser. No. 62/859,615 filed on Jun. 10, 2019. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is bits.

BACKGROUND

The following description includes information that may be useful in understanding the present invention. It is not an admission that any of the information provided herein is prior art or relevant to the presently claimed invention, or that any publication specifically or implicitly referenced is prior art.

Impact drivers are commonly used in the construction industry, especially to insert long fasteners and often replace the use of a drill as well as a traditional hammer and nails. This is generally because an impact driver applies significantly more torque to the fastener, which decreases the time required to insert the fastener. However, the bits used with impact drivers become worn with use and must be replaced over time.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for bits having a greater lifespan.

SUMMARY OF THE INVENTION

The inventive subject matter provides apparatus, systems and methods for bits that are preferably configured for use in impact drivers. Contemplated bits include a head portion or tip and a drive portion. A shank is disposed between the head portion and drive portion and thereby couples the two. Preferably, the shank comprises a set of rings that form raised portions extending from the outer surface of the shank, with adjacent rings spaced apart from one another by a gap or space.

It is especially preferred that a distance between two adjacent rings is not equal to a distance between two other adjacent rings of the set of rings. Preferably, the rings disposed further away from the head portion have a greater gap between them than rings disposed closer to the head portion.

In some embodiments, a distance between the head portion and a first ring of the set is less than a distance between the first ring and a second ring of the set.

It is further contemplated that the rings may have different widths, such that one ring of the set could have a width that is greater than another ring of the set, as further described below.

Preferably, the shank comprises a minimum diameter that is less than a minimum diameter of the drive portion and the head portion.

Advantageously, such variable widths of the gaps between adjacent rings of the set and the increase of the width of each gap depending on its distance from the head portion creates a pulsating action when the bit is used, which works to distribute torsion in the bit. By distributing the torsion, the inventors discovered that the bit outperforms prior art bits, and in testing the bits could be used 20-30 times more than those bits that lack the variably-spaced rings of the invention described herein.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
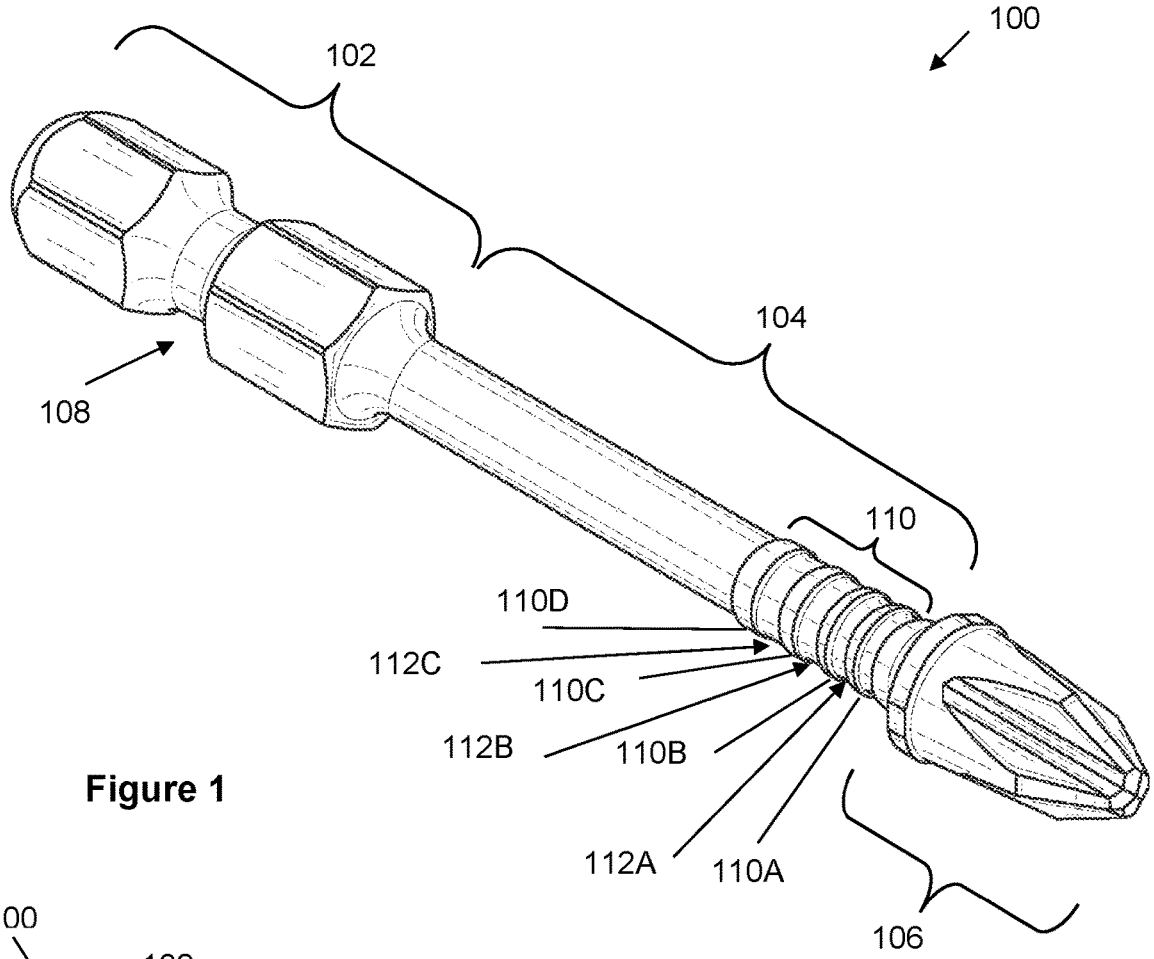
FIG. 1 is a perspective view of a first embodiment of a bit.
Figure 2:
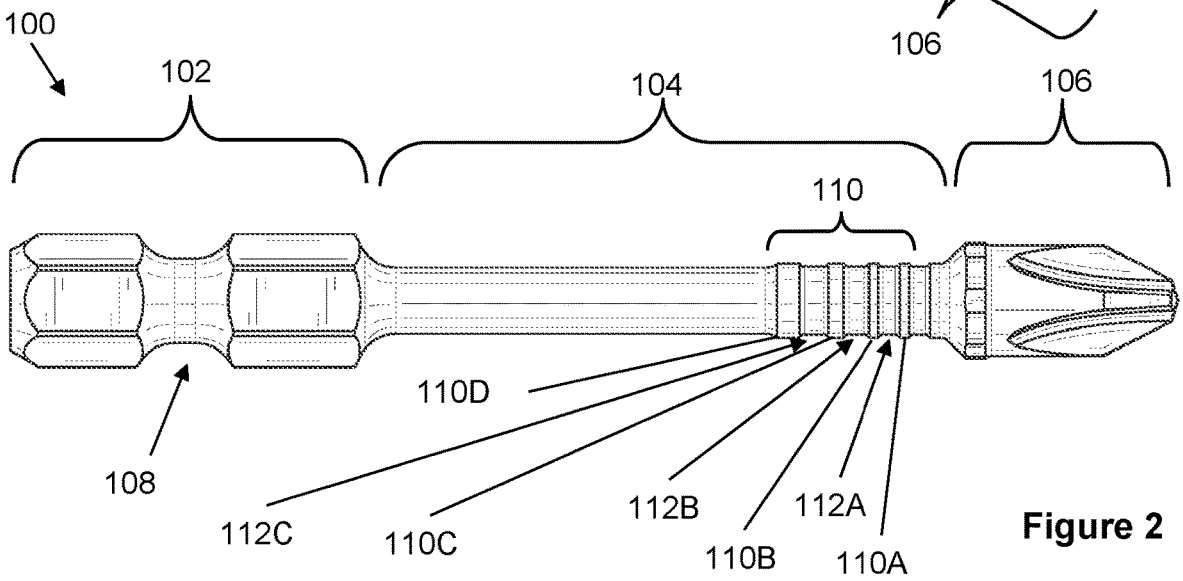
FIG. 2 is a side view of the first embodiment of the bit.
Figure 3:
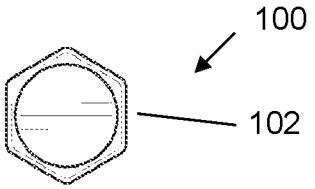
FIG. 3 is a bottom view of the first embodiment of the bit.
Figure 4:
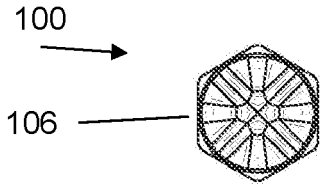
FIG. 4 is a top view of the first embodiment of the bit.

FIGS. 1-4 illustrate one embodiment of a bit 100 having a drive portion 102, a shank 104, and a head portion or tip 106, where the shank 104 is disposed between the drive portion 102 and the head portion 106.

In preferred embodiments, the drive portion 102 is hexagonal in cross-section, which facilitates engagement with various tools or adapters which themselves may have a corresponding hexagonal recess, such that the bit 100 can be inserted and torque from the tool can be transferred to rotate the bit 100, for example. Of course, the drive portion 102 could comprise alternative shapes and sizes to facilitate engagement with different tools without departing from the scope of the invention herein.

In some embodiments, the drive portion 102 may include a groove 108 disposed between adjacent hexagonal portions, such as shown in FIGS. 1-4. The groove 108 can be sized and dimensioned to engage with a quick-release mechanism (e.g., a ball detent) of a tool such as to hold (maintain a position of) the bit 100 within the recess of the tool, for example. Of course, it is contemplated that the drive portion 102 could alternatively lack such a groove, such as where an interference fit between the recess of the tool and drive portion 102 is used to hold the bit 100 in place.

The head portion 106 may comprise a Philips-style end as shown in FIGS. 1-4. However, it is alternatively contemplated that other tip configurations could be used such as a flat-head end, a hexagonal end, and so forth without departing from the scope of invention herein.

As discussed above, shank 104 can be disposed between the drive portion 102 and the head portion 106. The shank 104 preferably has a diameter that is less than a diameter of the drive portion 102 and is also less than a diameter of the head portion 106.

Shank 104 comprises a set of rings 110, each protruding from an outer surface of the shank 104, as shown in FIGS. 1-4. The set of rings 110 preferably comprises at least two rings 110A and 110B. Preferably, the rings 110 are disposed on the shank 104 closer to the head portion 106 rather than the drive portion 102.

As shown in FIGS. 1-4, the set of rings 110 disposed on the shank 104 comprises a first ring 110A, a second ring 110B, a third ring 110C, and a fourth ring 110D. In preferred embodiments, at least one of the rings 110 have a width that is different from another of the rings 110, and in particular, that the ring 110 furthest from the head portion 106 has a width that is greater than the ring 110 closest to the head portion 106.

Thus, for illustrative purposes, ring 110A may have a width equal to 0.5 mm, ring 110B may have a width equal to 0.5 mm, ring 110C may have a width equal to 0.8 mm, and ring 110D may have a width equal to 1.2 mm. In this example, rings 110A-110B (closest to the head portion 106) have a first width that is less than a width of ring 110C that is less than a width of ring 110D (furthest from the head portion 106).

Preferably, a space or gap is disposed between adjacent ones of the rings, which acts to create valleys or low points between adjacent ones of the rings 110. In this manner, gap 112A is disposed between the first ring 110A and the second ring 110B, gap 112B is disposed between the second ring 110B and the third ring 110C, and gap 112C is disposed between the third ring 110C and the fourth ring 110D.

Where there are at least two gaps, it is especially preferred that the distances between adjacent rings are not all equal (e.g., at least some of the gaps 112A-112C have different widths), such that a width of the gap between rings 110 further away from the head portion 106 is greater than a width of the gap between rings 110 closer to the head portion 106.

In one example, a width of gap 112A can be 0.5 mm, a width of gap 112B can be 0.8 mm, and a width of gap 112C can be 1.0 mm. Thus, each of the gaps 112A-112C have a different width, and the widths of the gaps increase the further away the gap is from the head portion 106.

In some embodiments, a distance between the first ring 110A and the head portion 106 can equal the width of the first gap 112A.

Figure 5:
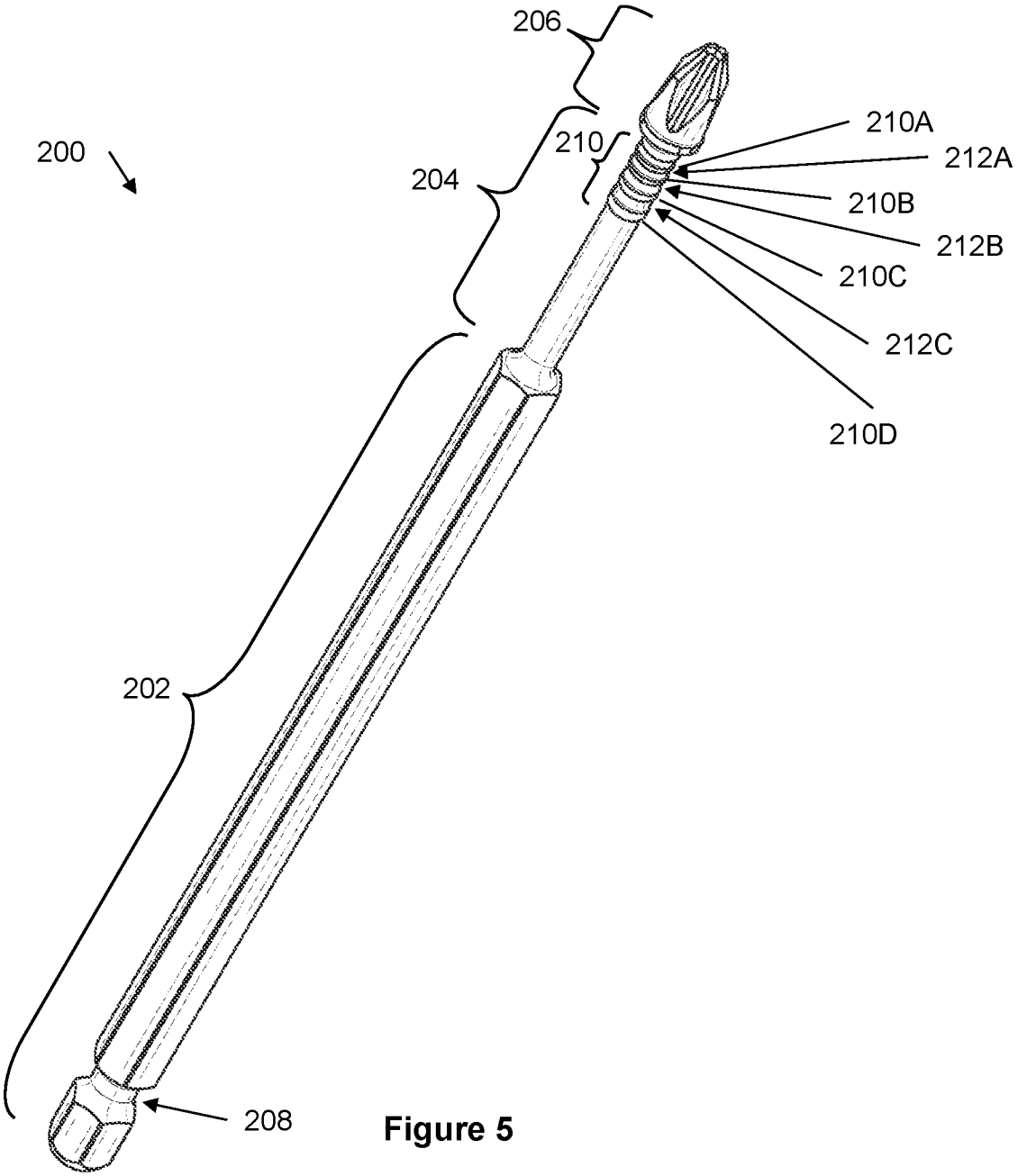
FIG. 5 is a perspective view of a second embodiment of a bit.
Figure 6:
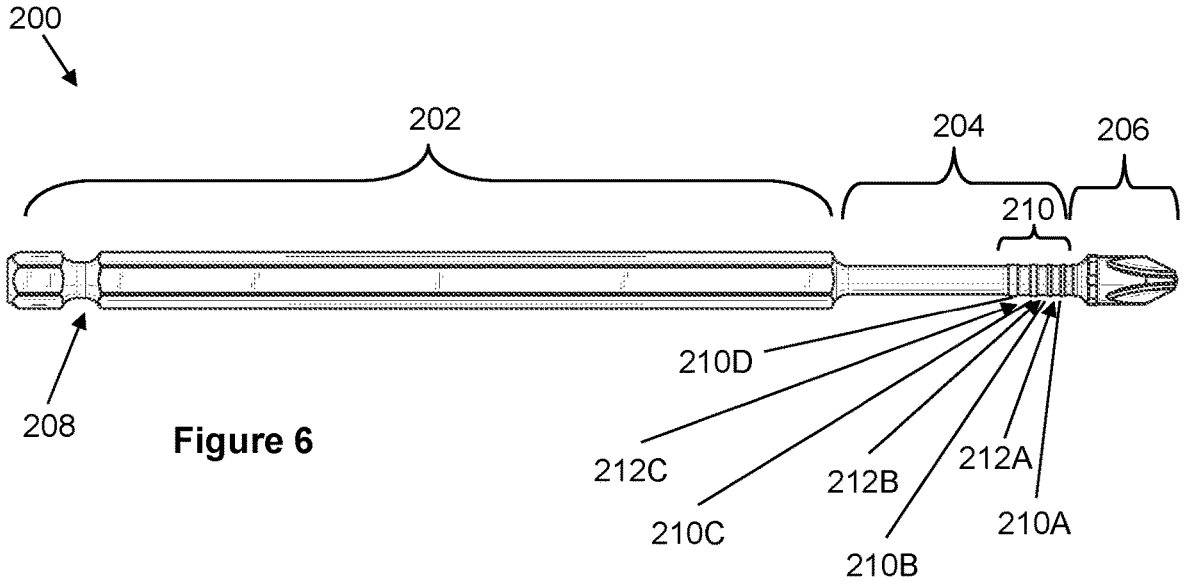
FIG. 6 is a side view of the second embodiment of the bit.
Figure 7:
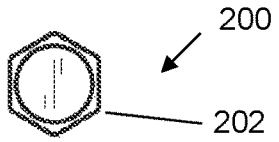
FIG. 7 is a bottom view of the second embodiment of the bit.
Figure 8:
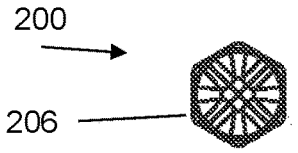
FIG. 8 is a top view of the second embodiment of the bit.

FIGS. 5-8 illustrate another embodiment of a bit 200 having a drive portion 202, a shank 204, and a head portion or tip 206, where the shank 204 is disposed between the drive portion 202 and the head portion 206. Compared with the bit 100 of FIG. 1, drive portion 202 is substantially longer than drive portion 102.

In preferred embodiments, the drive portion 202 is hexagonal in cross-section, which facilitates engagement with various tools or adapters which themselves may have a corresponding hexagonal recess, such that the bit 200 can be inserted and torque from the tool can be transferred to rotate the bit 200, for example. Of course, the drive portion 202 could comprise alternative shapes and sizes to facilitate engagement with different tools without departing from the scope of the invention herein.

In some embodiments, drive portion 202 may include a groove 208 disposed between adjacent hexagonal portions. The groove 208 can be sized and dimensioned to engage with a quick-release mechanism (e.g., a ball detent) of a tool such as to hold (maintain a position of) the bit 200 within the recess of the tool, for example. Of course, it is contemplated that the drive portion 202 could alternatively lack such a groove, such as where an interference fit between the recess of the tool and drive portion 202 is used to hold the bit 200 in place.

The head portion 206 may comprise a Philips-style end as shown in FIGS. 5-8. However, it is alternatively contemplated that other tip configurations could be used such as a flat-head end, a hexagonal end, and so forth without departing from the scope of invention herein.

As discussed above, shank 204 can be disposed between the drive portion 202 and the head portion 206. The shank 204 preferably has a diameter that is less than a diameter of the drive portion 202 and is also less than a diameter of the head portion 206.

Shank 204 comprises a set of rings 210, each protruding from an outer surface of the shank 204. The set of rings 210 are disposed on the shank 204 closer to the head portion 206 rather than the drive portion 202.

Bit 200 comprises a set of rings 210 having a first ring 210A, a second ring 210B, a third ring 210C, and a fourth ring 210D. In preferred embodiments, at least one of the rings 210 has a width that is different from another of the rings 210, and in particular, that the ring 210 furthest from the head portion 206 has a width that is greater than the ring 210 closest to the head portion 206.

Thus, for illustrative purposes, ring 210A may have a width equal to 0.5 mm, ring 210B may have a width equal to 0.5 mm, ring 210C may have a width equal to 0.8 mm, and ring 210D may have a width equal to 1.2 mm. In this example, rings 210A-210B (closest to the head portion 206) have a first width that is less than a width of ring 210C that is less than a width of ring 210D (furthest from the head portion 206).

Preferably, a space or gap is disposed between adjacent ones of the rings, which acts to create valleys or low points between adjacent ones of the rings 210. In this manner, gap 212A is disposed between the first ring 210A and the second ring 210B, gap 212B is disposed between the second ring 210B and the third ring 210C, and gap 212C is disposed between the third ring 210C and the fourth ring 210D.

Where there are at least two gaps, it is especially preferred that the distances between adjacent rings are not all equal (e.g., at least some of the gaps 212A-212C have different widths), such that a width of the gap between rings 210 further away from the head portion 206 is greater than a width of the gap between rings 210 closer to the head portion 206.

In one example, a width of gap 212A can be 0.5 mm, a width of gap 212B can be 0.8 mm, and a width of gap 212C can be 1.0 mm. Thus, each of the gaps 212A-212C have a different width, and the widths of the gaps increase the further away the gap is from the head portion 206.

In some embodiments, a distance between the first ring 210A and the head portion 206 can equal the width of the first gap 212A.

Figure 9:
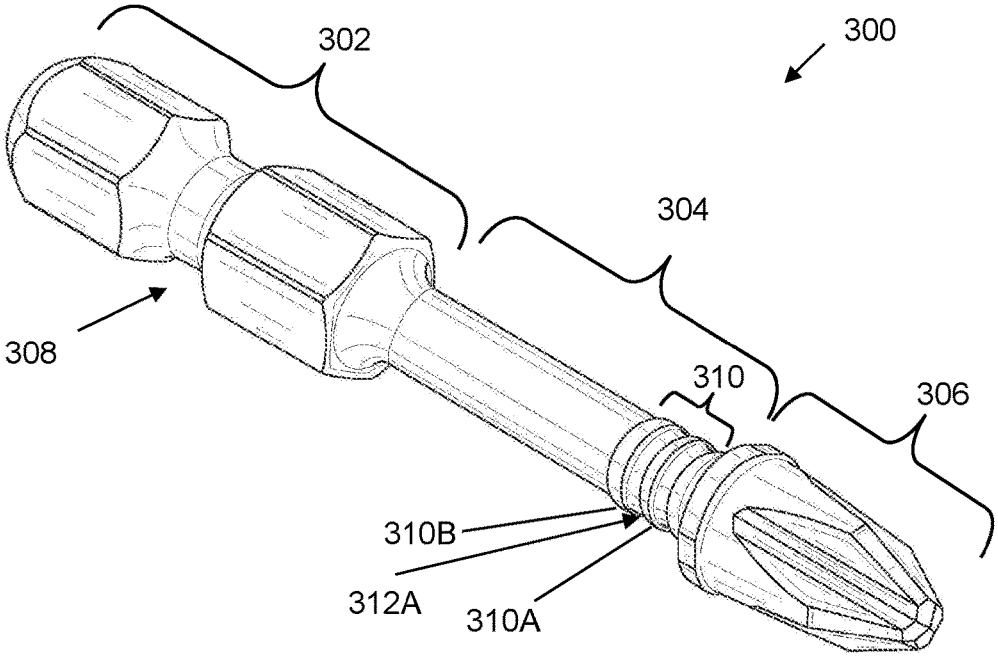
FIG. 9 is a perspective view of a second embodiment of a bit.
Figure 10:
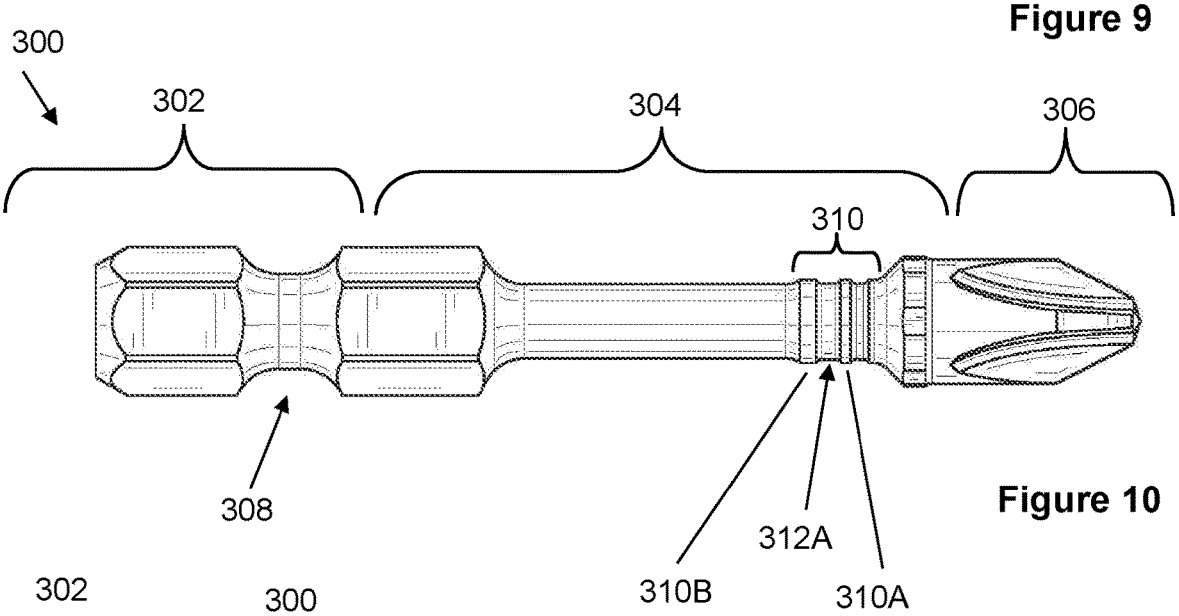
FIG. 10 is a side view of the second embodiment of the bit.
Figure 11:
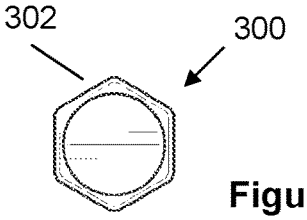
FIG. 11 is a bottom view of the second embodiment of the bit.
Figure 12:
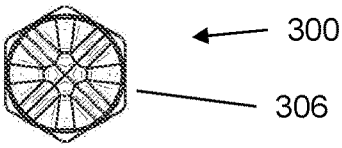
FIG. 12 is a top view of the second embodiment of the bit.

FIGS. 9-12 illustrate yet another embodiment of a bit 300 having a drive portion 302, a shank 304, and a head portion or tip 306, where the shank 304 is disposed between the drive portion 302 and the head portion 306. Compared with the bit 100 of FIG. 1, drive portion 302 is shorter longer than drive portion 102.

In preferred embodiments, the drive portion 302 is hexagonal in cross-section, which facilitates engagement with various tools or adapters which themselves may have a corresponding hexagonal recess, such that the bit 300 can be inserted and torque from the tool can be transferred to rotate the bit 300, for example. Of course, the drive portion 302 could comprise alternative shapes and sizes to facilitate engagement with different tools without departing from the scope of the invention herein.

In some embodiments, drive portion 302 may include a groove 308 disposed between adjacent hexagonal portions. The groove 308 can be sized and dimensioned to engage with a quick-release mechanism (e.g., a ball detent) of a tool such as to hold (maintain a position of) the bit 300 within the recess of the tool, for example. Of course, it is contemplated that the drive portion 302 could alternatively lack such a groove, such as where an interference fit between the recess of the tool and drive portion 302 is used to hold the bit 300 in place.

The head portion 306 may comprise a Philips-style end as shown in FIGS. 9-12. However, it is alternatively contemplated that other tip configurations could be used such as a flat-head end, a hexagonal end, and so forth without departing from the scope of invention herein.

As discussed above, shank 304 can be disposed between the drive portion 302 and the head portion 306. The shank 304 preferably has a diameter that is less than a diameter of the drive portion 302 and is also less than a diameter of the head portion 306.

Shank 304 comprises a set of rings 310, each protruding from an outer surface of the shank 304. The set of rings 310 are disposed on the shank 304 closer to the head portion 306 rather than the drive portion 302.

Bit 300 comprises a set of rings 310 having a first ring 310A and a second ring 310B. The second ring 310B preferably has a width that is greater than the first ring 310A. Thus, for illustrative purposes, ring 310A may have a width equal to 0.5 mm and ring 310B may have a width equal to 0.8 mm.

Preferably, a space or gap 312A is disposed between the first ring 310A and the second ring 310B. The space 312A preferably has a width that is greater than a space between the first ring 310A and the head portion 306.

Figure 13:
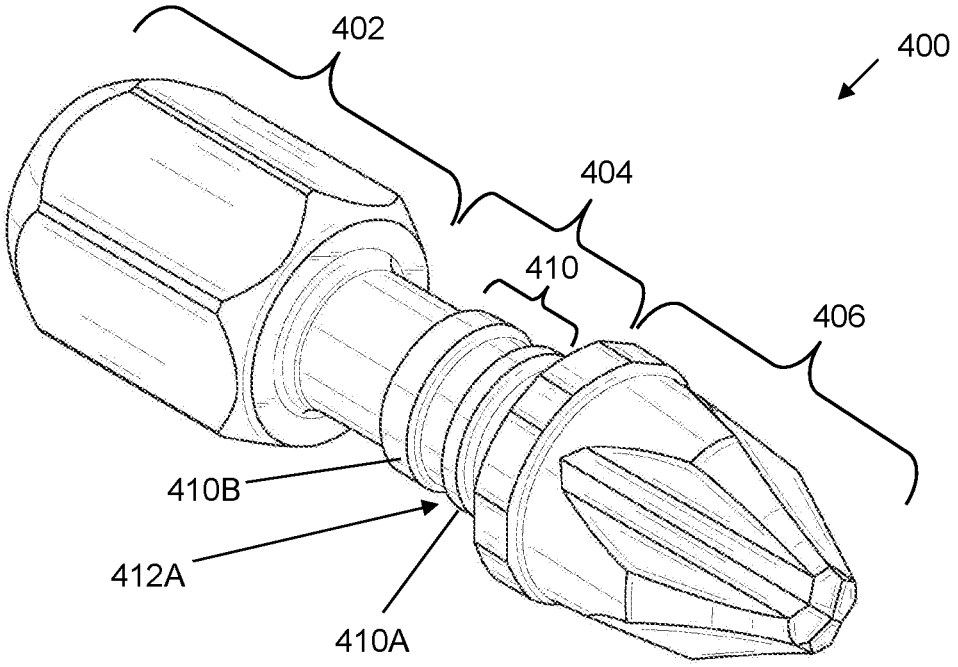
FIG. 13 is a perspective view of a second embodiment of a bit.
Figure 14:
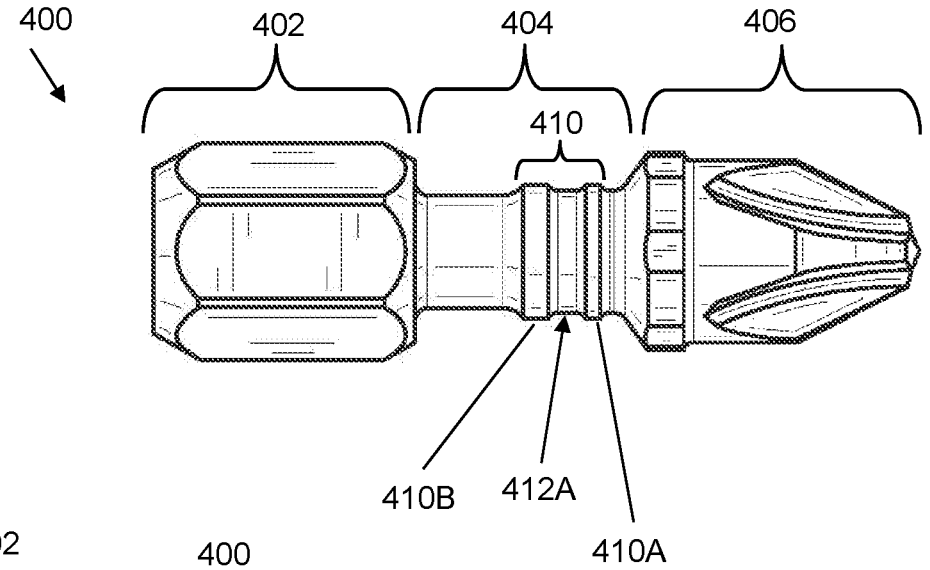
FIG. 14 is a side view of the second embodiment of the bit.
Figure 15:
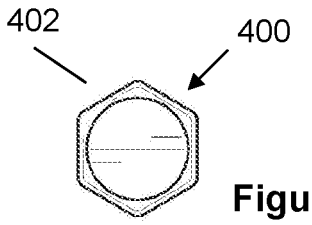
FIG. 15 is a bottom view of the second embodiment of the bit.
Figure 16:
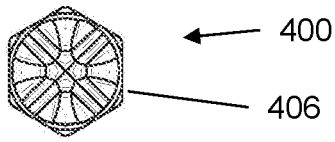
FIG. 16 is a top view of the second embodiment of the bit.

FIGS. 13-16 illustrate yet another embodiment of a bit 400 having a drive portion 402, a shank 404, and a head portion or tip 406, where the shank 404 is disposed between the drive portion 402 and the head portion 406. Compared with the bit 100 of FIG. 1, drive portion 402 is shorter longer than drive portion 102.

In preferred embodiments, the drive portion 402 is hexagonal in cross-section, which facilitates engagement with various tools or adapters which themselves may have a corresponding hexagonal recess, such that the bit 400 can be inserted and torque from the tool can be transferred to rotate the bit 400, for example. Of course, the drive portion 402 could comprise alternative shapes and sizes to facilitate engagement with different tools without departing from the scope of the invention herein.

The head portion 406 may comprise a Philips-style end as shown in FIGS. 13-16. However, it is alternatively contemplated that other tip configurations could be used such as a flat-head end, a hexagonal end, and so forth without departing from the scope of invention herein.

As discussed above, shank 404 can be disposed between the drive portion 402 and the head portion 406. The shank 404 preferably has a diameter that is less than a diameter of the drive portion 402 and is also less than a diameter of the head portion 406.

Shank 404 comprises a set of rings 410, each protruding from an outer surface of the shank 404. The set of rings 410 are disposed on the shank 404 closer to the head portion 406 rather than the drive portion 402.

Bit 400 comprises a set of rings 410 having a first ring 410A and a second ring 410B. The second ring 410B preferably has a width that is greater than the first ring 410A. Thus, for illustrative purposes, ring 410A may have a width equal to 0.5 mm and ring 410B may have a width equal to 0.9 mm.

Preferably, a space or gap 412A is disposed between the first ring 410A and the second ring 410B. The space 412A preferably has a width that is greater than a space between the first ring 410A and the head portion 406.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A bit, comprising:

a drive portion;

a head portion;

a shank coupling the drive and head portions, wherein the shank comprises a set of rings spaced apart from one another and arranged in series along the shank, wherein the set of rings comprises at least a first ring, a second ring, and a third ring, wherein the first ring is disposed between the second ring and the head portion, and wherein the second ring is disposed between the first ring and the third ring;

wherein the shank further comprises a set of valleys each defined by and disposed between two adjacent rings, wherein the set of valleys comprises at least a first valley and a second valley, wherein the first valley is defined on a first end by the first ring and defined at a second end by the second ring, and wherein the second valley is defined at a first end by the second ring and defined at a second end by the third ring; and wherein a first distance between the head portion and the first ring is less than a second distance between the first ring and the second ring;

wherein a third distance between the second ring and the third ring is different than the second distance; and wherein a diameter of each of the first ring, second ring, and third ring is less than a diameter of the drive portion.

2. The bit of claim 1, wherein the second ring has a width that is greater than a width of the first ring.

3. The bit of claim 1, wherein the shank comprises a minimum diameter that is less than a minimum diameter of the drive portion.

4. The bit of claim 1, wherein the shank comprises a minimum diameter that is less than a minimum diameter of the head portion.

5. The bit of claim 1, wherein the drive portion comprises a hexagonal cross-section.

6. The bit of claim 5, wherein the drive portion comprises a groove disposed between first and second hexagonal portions.

7. The bit of claim 1, wherein the third distance is greater than the second distance.

8. A bit, comprising:

a drive portion;

a head portion;

a shank coupling the drive and head portions, wherein the shank comprises first, second and third rings spaced apart from one another and arranged in series along the shank, wherein the second ring is disposed between the first and third rings, and wherein the first ring is disposed between the second ring and the head portion, wherein the first and second rings are spaced apart by a first distance, and wherein the second and third rings are spaced apart by a second distance;

wherein the shank further comprises a set of valleys each defined by and disposed between two adjacent rings, wherein the set of valleys comprises at least a first valley and a second valley, wherein the first valley is defined on a first end by the first ring and defined at a second end by the second ring, and wherein the second valley is defined at a first end by the second ring and defined at a second end by the third ring; and wherein the first distance is less than the second distance, and wherein a diameter of each of the first ring, second ring, and third ring is less than a diameter of the drive portion.

9. The bit of claim 8, wherein the third ring has a width that is greater than a width of the second ring.

10. The bit of claim 9, wherein the third ring has a width that is greater than a width of the first ring.

11. The bit of claim 10, wherein the width of the first ring is equal to the width of the second ring.

12. The bit of claim 8, wherein the shank comprises a minimum diameter that is less than a minimum diameter of the drive portion.

13. The bit of claim 8, wherein the shank comprises a minimum diameter that is less than a minimum diameter of the head portion.

14. The bit of claim 8, wherein the drive portion comprises a hexagonal cross-section.

15. The bit of claim 14, wherein the drive portion comprises a groove disposed between first and second hexagonal portions.

16. The bit of claim 8, wherein the first ring is closer to the head portion than the drive portion.

* * * * *